US009324551B2

(12) United States Patent
Taniguchi et al.

(10) Patent No.: US 9,324,551 B2
(45) **Date of Patent: *Apr. 26, 2016**

(54) MASS SPECTROMETER AND METHOD OF DRIVING ION GUIDE

(71) Applicant: SHIMADZU CORPORATION, Kyoto (JP)

(72) Inventors: Junichi Taniguchi, Kyoto (JP); Daisuke Okumura, Kyoto (JP); Hiroto Itoi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/467,293

(22) Filed: Aug. 25, 2014

(65) Prior Publication Data

US 2014/0361163 A1 Dec. 11, 2014

Related U.S. Application Data

(63) Continuation-in-part of application No. 13/890,577, filed on May 9, 2013, now Pat. No. 8,822,918, which is a continuation-in-part of application No. PCT/JP2012/056850, filed on Mar. 16, 2012.

(30) Foreign Application Priority Data

May 28, 2012 (JP) ..... 2012-120383

(51) Int. Cl.
*H01J 49/00* (2006.01)
*H01J 49/06* (2006.01)
*H01J 49/02* (2006.01)

(52) U.S. Cl.
CPC ..... *H01J 49/063* (2013.01); *H01J 49/022* (2013.01)

(58) Field of Classification Search
USPC ..... 250/281, 282, 283, 284
See application file for complete search history.

(56) References Cited

U.S. PATENT DOCUMENTS 7,501,622 B2 3/2009 Kawato
8,138,474 B2 3/2012 Wollnik et al.

(Continued)

FOREIGN PATENT DOCUMENTS

JP 2005-522845 A 7/2005
JP 2009-222554 A 10/2009

(Continued)

OTHER PUBLICATIONS

Japanese Office Action issued Dec. 2, 2014.

(Continued)

*Primary Examiner* — Nicole Ippolito
(74) *Attorney, Agent, or Firm* — Sughrue Mion, PLLC

(57) ABSTRACT

A method of operating an electrode changeover switch which switches the connection state of electrodes, the electrode changeover switch is provided in the wiring path between eight electrodes through, arranged rotation-symmetrically about ion optical axis, and voltage generation switch which generates square wave high voltage ±V. When switch is switched as shown in the drawing, two circumferentially adjacent rod electrodes are connected to form one set, a square wave voltage of opposite phase is applied to circumferentially adjacent sets, and an effectively quadrupole electric field is formed. When switch is switched, a square wave voltage of opposite phase is applied to circumferentially adjacent rod electrodes and an octupole electric field is formed. In this way, by switching the switch according to the mass range, etc., it becomes possible to rapidly switch the number of poles of a multipole electric field and to suitably transport ions.

9 Claims, 12 Drawing Sheets

(56) References Cited

U.S. PATENT DOCUMENTS

| | | | | |
|---|---|---|---|---|
| 8,822,918 | B2 * | 9/2014 | Taniguchi | H01J 49/063 250/281 |
| 2003/0189171 | A1 | 10/2003 | Londry et al. | |
| 2005/0017194 | A1 | 1/2005 | Matsuya et al. | |
| 2008/0035842 | A1 | 2/2008 | Sudakov et al. | |
| 2009/0072136 | A1 | 3/2009 | Pringle et al. | |
| 2009/0230301 | A1 | 9/2009 | Furuhashi et al. | |
| 2010/0308218 | A1 | 12/2010 | Wang | |
| 2011/0057094 | A1 | 3/2011 | Wollnik et al. | |
| 2013/0075602 | A1 | 3/2013 | Stoermer | |
| 2013/0240726 | A1 | 9/2013 | Hasegawa et al. | |

FOREIGN PATENT DOCUMENTS

| | | | |
|---|---|---|---|
| JP | 2009-277376 | A | 11/2009 |
| JP | 2012-084288 | A | 4/2012 |
| WO | 03/088305 | A1 | 10/2003 |
| WO | 2010/136779 | A1 | 12/2010 |

OTHER PUBLICATIONS

Japanese Office Action, dated May 7, 2015, issued in corresponding Japanese Patent Application No. 2012-120383.

* cited by examiner

MASS SPECTROMETER AND METHOD OF DRIVING ION GUIDE

CROSS REFERENCE TO RELATED APPLICATIONS

The present application is a continuation-in-part of U.S. application Ser. No. 13/890,577 filed on May 9, 2013, published as US 2013-0313421 on Nov. 28, 2013, and a continuation-in-part of international application PCT/JP2012/056850 filed on Mar. 16, 2012 and published as WO/2013/136509, the contents of which are hereby incorporated by reference in their entirety.

TECHNICAL FIELD

The present invention relates to an ion guide which focuses ions and transports them to a subsequent stage, to a mass spectrometry device using said ion guide, and to a method for operating the ion guide.

BACKGROUND ART

To achieve high detection sensitivity in a mass spectrometry device, it is important for ions derived from sample components generated in an ion source to be fed into the mass spectrometer, such as a quadrupole mass filter, etc., as efficiently as possible. In particular, in mass spectrometry devices such as liquid chromatography-mass spectrometry device, where ionization is performed under atmospheric pressure, even under conditions of low vacuum atmosphere, i.e. when there are relatively many residual gas molecules, it is important to reduce the influence of scattering due to collision with such gas molecules as much as possible, and to transport ions to the mass spectrometer while minimizing losses. To achieve this objective, an ion optical element known as an ion guide is used for focusing the ions sent from the preceding stage and feeding them into the mass spectrometer, etc. of the next stage.

The general configuration of an ion guide is a multipole configuration in which 4, 6, 8 or more substantially round cylindrical rod electrodes are spaced apart from each other at the same angle and arranged in parallel to each other so as to surround the ion optical axis. In a multipole ion guide of this sort, normally, high frequency voltages of the same amplitude and frequency but of inverted phase are applied respectively to two rod electrodes adjacent in the circumferential direction about the ion optical axis. When this sort of high frequency voltage is applied to each rod electrode, pseudo-potential barriers are formed by the high frequency electric field generated between the electrodes, and ions are reflected between these potential barriers as they travel downstream. As a result, ions scattered due to collision with residual gas molecules can also be stably transported and the sensitivity of the device can be increased.

Quadrupole, hexapole and octupole configurations are commonly used for multipole ion guides. It is known that when the voltage applied to the rod electrodes is the same, the greater the number of poles, the greater the ion confinement potential in the vicinity of the rod electrodes. It is furthermore known that the ability to focus ions near the ion optical axis is higher when the number of poles is smaller. FIG. 11 is a drawing which schematically illustrates the relationship between radial distance r from the ion optical axis (center) and the confinement potential $\phi$ in a quadrupole ion guide and an octupole ion guide (see Patent literature 1, etc.).

It can be seen that in an octupole ion guide, the confinement potential rises sharply and the ion confinement capacity is higher at locations near the rod electrodes (away from the center). On the other hand, since the bottom of the potential well is wide, ions can be readily present not just near the ion optical axis but also at locations away from the optical axis. In other words, the degree of concentration of ions toward the vicinity of the ion optical axis is not particularly good. By contrast, with a quadrupole ion guide, the confinement potential rise is gradual, so the ion confinement capacity is relatively low, but the bottom of the potential well is limited to a narrow range in the vicinity of the ion optical axis, so ions are focused near the ion optical axis.

It will be noted that in a quadrupole ion guide, the confinement potential can be increased by increasing the amplitude of the high frequency voltage applied to each rod electrode, but a quadrupole ion guide has a low mass cutoff (LMC) limiting condition (see Patent literature 2, etc.), with the LMC increasing the more one raises the driving voltage. Thus, when driving voltage is raised in order to increase the confinement potential, the problem occurs that it becomes difficult to stably transport ions with a low mass-charge ratio, so there are limits to increasing the driving voltage.

Since the ion transport characteristics differ in this way between quadrupole ion guides and octupole ion guides, and also multipole ion guides with other numbers of poles, it is desirable to select an ion guides with the appropriate number of poles according to the conditions of use, such as the mass-charge ratio range of the ions to be analyzed. Specifically, when analyzing ions across a wide mass-charge ratio range, it is preferable to use to an octupole ion guide with high confinement capacity, and to detect ions with a specific mass-charge ratio or ions with a narrow mass-charge ratio range at high sensitivity, it is preferable to use a quadrupole ion guide, focus ions near the ion optical path and transport ions to the subsequent stage ion optical system at low loss. Because of this, in order to obtain good analysis results, it is desirable to be able to rapidly switch the effective number of poles of the multipole ion guide even during execution of liquid chromatography/mass spectrometry (LC/MS) or gas chromatography/mass spectrometry (GC/MS).

However, in conventional mass spectrometry devices, switching the effective number of poles as described above is difficult for the following reasons. Namely, the high frequency voltage applied to each rod electrode of the multipole ion guide requires an amplitude of approximately several hundred V, and to generate such a voltage, LC resonant circuits employing inductance and capacitance are generally used in the prior art. FIG. 10 is a simplified diagram showing the electrode configuration and driving circuit of a conventional octupole ion guide.

In FIG. 10, the eight rod electrodes 221 through 228 contained in ion guide electrode unit 200 are arranged so as to be inscribed into a virtual round cylindrical body P having the ion optical axis C at its center and so as to be spaced apart at equal angular intervals (45°) in the circumferential direction. Sets of four of these eight rod electrodes 221 through 228, consisting of every other one in the circumferential direction (rod electrodes 221, 223, 225 and 227; and rod electrodes 222, 224, 226 and 228) are electrically connected, and voltage from a power supply unit 500 is applied to each of these two electrode groups. Looking at the ion guide electrode unit 200 from the power supply unit 500, an electrostatic capacitance C' exists between circumferentially adjacent rod electrodes, and this electrostatic capacitance C' is connected in parallel to a variable capacitance capacitor 503 having a capacitance C. The LC resonant circuit, formed by this electrostatic capacitance C' and capacitance C of variable capacitance capacitor 503 and the inductance L of coil 502, increases the amplitude of the high frequency signal inputted from high frequency signal generating unit 501, which is then applied to the rod electrodes 221 through 228. The resonant frequency is fixed, and the capacitance C of the variable capacitance capacitor 503 is adjusted to match the resonant frequency fLC of the LC resonant circuit to a specific frequency f.

In FIG. 10, if four electrode pair sets are formed taking two circumferentially adjacent rod electrodes as one set, and the electrical connection is switched by a switch such as an electromagnetic relay so that a high frequency voltage of reverse polarity is applied to circumferentially adjacent electrode pairs, a quadrupole electric field can be formed in the space surrounded by rod electrodes 221 through 228. That is, the effective number of poles can be switched from 8 to 4. However, when this sort of switching is performed, the electrostatic capacitance C' between the rod electrodes changes, and thus the resonant frequency fLC of the LC resonant circuit deviates from the specific frequency f and adequate amplification of amplitude becomes impossible. In other words, high speed switching as described above was not possible because the capacitance C of variable capacitance capacitor 503 needs to be readjusted in response to change in electrostatic capacitance C' between the rod electrodes in order to modify the effective number of poles. Furthermore, the switching itself was a very laborious operation and was not practical.

Additionally, to meet demands for enhanced sensitivity, enhanced accuracy or other improved qualities in the mass spectrometers, it is necessary to bring the shape of equipotential lines in the electric field in the ion guide closer to a theoretically-derived predetermined curve, thereby improving the qualities such as ion receiving properties and ion passing properties. To this end, the accuracy in the arrangement of the respective rod electrodes in the ion guide needs to be improved, and in order to achieve the improvement, the present applicant proposed an ion guide having a novel configuration in Patent Literature 3. One example of the ion guide is described with reference to FIG. 12 to FIG. 15.

FIG. 12A is a side view of an ion guide unit 100, and FIG. 12B and FIG. 12C are respectively sectional views on the lines A-A' and B-B' in FIG. 12A. The ion guide unit 100 includes an ion guide 110 in which eight metal plates extending in the direction of an ion optical axis C are employed as electrodes, and a hollow cylindrical case 140 that encloses the ion guide 110. The respective electrodes of the ion guide 110 are arranged rotationally symmetrical so as to be apart at an interval of an angle of 45° around the ion optical axis C, with their longitudinal-side end surfaces directed toward the ion optical axis C. Here, four electrodes alternately positioned among the eight electrodes are employed as first electrodes 111, and four electrodes adjacent thereto are employed as second electrodes 112.

FIG. 13 is a perspective view of one of the first electrodes 111. In the first electrode 111, an end edge on the side of the ion optical axis C has an arc shape or a hyperbolic shape bulging toward the ion optical axis C in a sectional plane perpendicular to the ion optical axis C. Further, the end edge on the side of the ion optical axis C is slightly inclined with respect to the ion optical axis C so as to become slightly apart from the ion optical axis C as an ion travels (rightward in FIG. 12C and FIG. 13). Because of the inclination, the intensity of the multipole electric field is smaller toward the outlet side of the ion guide 110, thereby decelerating flying ions. The other three plate electrodes of the first electrode 111, and the four electrode plates of the second electrodes 112 adjacent thereto also have the same shape.

The case 140 includes a tubular section 141 that encloses the first electrodes 111 and the second electrodes 112, a first support section 142 that is attached to one end portion of the tubular section 141 to support one end surfaces (left-side end surfaces in FIG. 12C) of the respective electrodes, a second support section 143 that is attached to the other end portion of the tubular section 141, and a disk spring fixing section 144 that fixes a disk spring 130 as shown in FIG. 14A by sandwiching the disk spring 130 between the disk spring fixing section 144 and the second support section 143. The first support section 142 and the second support section 143 are made of insulators such as ceramics, plastics or the like, and an opening for allowing ions to pass therethrough is provided in the center. A cylindrical through hole is provided in the second support section 143 at a position corresponding to each of the electrodes.

The disk spring 130 shown in FIG. 14A is made of metal, and includes a ring-shaped frame portion 131 and eight spring portions 132 working as cantilever springs projecting inward from the frame portion 131. The spring portions 132, each having a T shape with the head inward, are arranged so that the heads are close, but without contacting, to each other.

A thin plate 150 made of metal as shown in FIG. 14B is placed on a surface supporting the electrodes in the first support section 142. The thin plate 150 includes a ring-shaped frame portion 151 and four metal contacts 152 projecting inward from the frame portion 151. In the thin plate 150 placed on the first support section 142, the positions of the metal contacts 152 correspond to the positions of the first electrodes 111. Accordingly, the thin plate 150 contacts only the first electrodes 111, and does not contact the second electrodes 112.

FIG. 15 is a plan view of a state in which the disk spring 130 and the disk spring fixing section 144 are removed from the end portion on the side of the second support section 143 of the ion guide unit 100. Insulating spacers 121 made of insulators are inserted into four holes corresponding to the first electrodes 111, and conducting spacers 122 made of conductors are inserted into four holes corresponding to the second electrodes 112, as to the eight through holes provided in the second support section 143. The respective spacers are cylindrical members having the same length, which sets one end of the spacer to slightly project from the surface of the second support section 143 when the other end is in contact with the electrode.

FIG. 16 is a partial plan view of a state in which the disk spring 130 and the disk spring fixing section 144 are attached to the ion guide unit 100 shown in FIG. 15. The disk spring 130 is arranged such that the right and left ends close to each other of the adjacent spring portions 132 press the projecting portion of one insulating spacer 121 or one conducting spacer 122. Accordingly, the disk spring 130 is insulated from the first electrodes 111 by the insulating spacers 121, and electrically connected to the second electrodes 112 via the conducting spacers 122.

In the ion guide unit 100 having the above configuration, the spring portions 132 of the disk spring 130 press the first electrodes 111 and the second electrodes 112 toward the first support section 142 via the insulating spacers 121 or the conducting spacers 122. Accordingly, the respective electrodes 111 and 112 are sandwiched between the disk spring 130 and the first support section 142 from both sides and thereby fixed. At this point, end surfaces of the first electrodes 111 are in contact with the insulating spacers 121 or the metal thin plate 150, and end surfaces of the second electrodes 112 are in contact with the conducting spacers 122 or the second support section 143 made of an insulator. A voltage VDC+ v·cos ωt in which a radio-frequency voltage v·cos ωt is superimposed on a direct current voltage VDC is applied to the first electrodes 111 via the thin plate 150, and a voltage VDC-v·cos ωt in which a radio-frequency voltage of inverted phase (i.e., phase shifted by 180°) is superimposed on the same direct current voltage is applied to the second electrodes 112 via the disk spring 130 and the conducting spacers 122 from a voltage application section (not shown in the drawing). Accordingly, a multipole radio-frequency electric field is formed in the space surrounded by the edge end surfaces of the eight electrodes 111 and 112, and ions introduced therein are converged.

Since the end edges of the eight electrodes 111 and 112 facing the ion optical axis C have an arc shape or a parabolic shape convex toward the ion optical axis C in a plane perpendicular to the ion optical axis C, an electric field whose equipotential lines are shaped along the curve is generated in the vicinity of the electrodes 111 and 112. Thus, an electric field nearly an ideal state can be formed in the space surrounded by the end surfaces of the respective electrodes 111 and 112.

Recent mass spectrometers tend to have complicated configurations where, for example, a plurality of multipole-type ion guides as described above are used. In a liquid-chromatograph tandem quadrupole mass spectrometer described in Non Patent Literature 1, for example, a two-stage octupole-type ion guides are provided between an ion source and a first-stage quadrupole mass filter, and a quadrupole-type ion guide is disposed within a collision cell. That is, a plurality of ion guides having different number of poles are used in an apparatus. In conventional mass spectrometers, ion guides having different number of poles as described above have respective configurations different from each other. For example, when the above ion guide unit 100 is used, it is necessary to change not only the number of the metal plate electrodes, but also the shape of the members for holding the metal plate electrodes, such as the first support section 142, the second support section 143 and the disk spring 130, according to the number of poles. If, in the mass spectrometer using a plurality of ion guides as described above, ion guides having the same structure can be used, it is advantageous in reducing the cost.

CITATION LIST

Patent Literature (Patent literature 1) Japanese Unexamined Patent Application Publication 2009-222554

(Patent literature 2) Japanese Unexamined Patent Application Publication 2012-84288

(Patent literature 3) Japanese Unexamined Patent Application Publication 2010-149865 A

Non-Patent Literature (Non-Patent Literature 1) "Triple Quadrupole LC/MS/MS system LCMS-8030", Shimadzu Corporation

SUMMARY OF THE INVENTION

Aspects of the present invention were made in view of the aforementioned problems, its object being to provide an ion guide which makes it possible to favorably transport ions by forming multipole electric fields with different numbers of poles as appropriate to the mass-charge ratio range of the ions to be analyzed and the purpose of analysis even while analysis is being performed. Furthermore, other aspects of the present invention aim to provide a mass spectrometer including said ion guide or a plurality of ion guides with a different number of poles, the mass spectrometer capable of using ion guides having the same mechanical configuration and structure as the plurality of ion guides regardless of the difference in the number of poles. Also, another object of the present invention is to provide a method of operating the ion guide.

Means for Solving the Problem

In an aspect of the present invention, which was made to resolve the aforementioned problem, a method is provided for operating an ion guide, in which the ion guide contains an electrode unit in which N (where N is an integer not less than 6) rod-shaped or plate-shaped electrodes are arranged so as to surround an ion optical axis and which transports ions to a subsequent stage while focusing the ions by the action of a high frequency electric field formed in the space surrounded by said N electrodes, characterized in that it comprises:

- a voltage generator which generates a first square wave voltage of predetermined frequency and predetermined amplitude and a second square wave voltage of opposite phase to said first square wave voltage as voltages for forming a high frequency electric field in the space surrounded by said N electrodes; and
- a connection switch which switches the electrode unit between a first state and a second state;
- wherein in the first state, the electrodes are grouped in a number 2M of sets (where M is an integer not less than 2),
- in the second state, the electrodes are grouped in a number 2L of sets (where L is an integer not less than 3 and greater than M); and
- in both said first and second states, each of the sets includes either only one of the electrodes or a plurality of circumferentially adjacent electrodes electrically connected to one another;

and the method comprises:

- causing an electrical connection to be established between electrodes of said voltage generator and said electrode unit such that the first square wave voltage is applied to one of the sets and the second square wave voltage is applied to another of the sets which is circumferentially adjacent to the one of the sets.

In the ion guide operation method according to the present invention, the connection switch can be a switch using a semiconductor switching element or a relay having metal contact points, but the former is more appropriate when switching is to be performed at high speed.

As a preferable mode of operating the ion guide according to the present invention, a configuration may be employed which allows switching such that, in said second state, all of the sets consist of one electrode each, and in said first state, all of the sets consists of P (where P is an integer not less than 2) circumferentially adjacent electrodes.

As another preferable mode of operating the ion guide according to the present invention, a configuration may be employed which allows switching such that, in said second state, all of the sets consist of P circumferentially adjacent electrodes, and in said first state, all of the sets consist of Q (where Q is an integer greater than P) circumferentially adjacent electrodes.

In both the aforesaid modes, the number of electrodes making up each set is equal in both the first and the second state. Furthermore, the same square wave voltage is applied to the electrodes making up the same set, so no potential gradient is produced in the space between those electrodes, and thus, these electrodes can be regarded as a single electrode in terms of the electric field. Consequently, in the aforesaid two modes, in both the first state and the second state, the square wave voltage applied to the electrodes forms a high frequency electric field, symmetrical about the ion optical axis in the plane orthogonal to the ion optical axis, in the space surrounded by the electrodes. Therefore, the ions introduced into the ion guide as a whole progress along the ion optical axis while oscillating in the vicinity of the ion optical axis due to the effect of the high frequency electric field.

Furthermore, upon switching between the first state and second state by the switching of the electrical connections of the connection switch, the voltage applied to at least a portion of the electrodes changes from the first square wave voltage to the second square wave voltage, or the opposite. Since the number of sets arranged about the ion optical axis differs between the first set and the second set, the effective number of poles of the high frequency electric field is changed by the switching. Since the ion confinement capacity and the ability to focus ions toward the vicinity of the ion optical axis depend on the number of poles of the high frequency electric field, as described above, by switching the electrical connections so that the effective number of poles changes according to the mass-charge ratio range, etc. of the ions to be analyzed, it becomes possible as a whole to efficiently capture, and transport to the subsequent stage, ions across a wide mass-charge ratio range, or to particularly concentrate near the ion optical axis, and transport to the subsequent stage, ions in a narrow mass-charge ratio range.

With the ion guide operation method according to the present invention, only the square wave voltage generated by the voltage generator is switched when changing the effective number of poles of the high frequency electric field, as described above, so the switching is completed in a short time and an electric field corresponding to the voltage applied after switching is formed immediately after switching. Thus, it becomes possible to perform the switching in nearly real time even while an analysis is running, and to bring the ion non-sensing time accompanying the switching to nearly zero. Furthermore, the frequency and amplitude of the rectangular wave voltage generated by the voltage generator are essentially unaffected by the electrodes which constitute the load, so the switching does not require any sort of accompanying adjustment.

With the ion guide operation method according to the present invention, the N, M and L parameter values can take on arbitrary values subject to the respective restrictions. However, N, just like M and L, are usually even numbers. Furthermore, typically, 4M=2L=N, that is, it is preferable to enable switching such that, in the second state, all the sets consist of one electrode each, and in the first state, all the sets consist of two circumferentially adjacent electrodes.

Moreover, it is preferable if M=2, L=4 and N=8. In this case, the ion guide according to the present invention functions effectively either as a quadrupole ion guide or an octupole ion guide based on the switching of the connection by the connection switch. As discussed above, when it functions as a quadrupole ion guide, the ion confinement capacity is low, but the confined ions are focused near the ion optical axis, which is useful for transporting ions having a specific mass-charge ratio or a relatively small amount of ions of a narrow mass-charge ratio range to the subsequent stage at low loss. On the other hand, when it functions as an octupole ion guide, the ion confinement capacity is high, which is useful for transporting a large amount of ions of a wide mass-charge ratio range to the subsequent stage.

Furthermore, with the ion guide operation method according to the present invention, the shape of the high frequency electric field formed in the space surrounded by the electrodes can be made asymmetrical about the ion optical axis by making the number of electrodes making up each set nonuniform. It is thereby possible to displace the bottom of the pseudo-potential well from the central axis of electrode arrangement and to implement an off-axis ion optical system in which the ion optical axis of ions which enter the ion guide is offset from the ion optical axis of ions outputted from the ion guide. With the connection switch, one can then rapidly switch between an off-axis ion optical system and a normal ion optical system in which the input axis and output axis are located on the same line, enabling differential use whereby, for example, under conditions where there are many neutral particles constituting noise, the off-axis ion optical system would be used, and under conditions where the neutral particles have hardly any influence, the normal ion optical system would be used.

Furthermore, a mass analysis device comprising an ion guide according to the present invention can be configured so as to comprise a controller which controls the switching of connections by the connection switch according to the analysis conditions including the mass-charge ratio range of ions to be analyzed. With such a configuration, for example, in a case where scanning measurement across a predetermined mass-charge ratio range and SIM measurement targeting a particular mass-charge ratio are performed while switching over a short period of time, the ion guide according to the present invention can be made to function as a multipole ion guide suited respectively for scanning measurement and SIM measurement, allowing good analysis results to be obtained for both types of measurement.

The ion guide operation method and mass spectrometry device according to the present invention make it is possible to favorably transport ions to the subsequent stage and obtain good analysis results by forming multipole electric fields with different numbers of poles as appropriate to the mass-charge ratio range of the ions to be analyzed and the purpose of analysis even while analysis is being performed.

DETAILED DESCRIPTION OF THE EXEMPLARY EMBODIMENTS

A mass spectrometry device constituting an example embodiment of the present invention (first example embodiment) will be described below with reference to the appended drawings.

Figure 1:
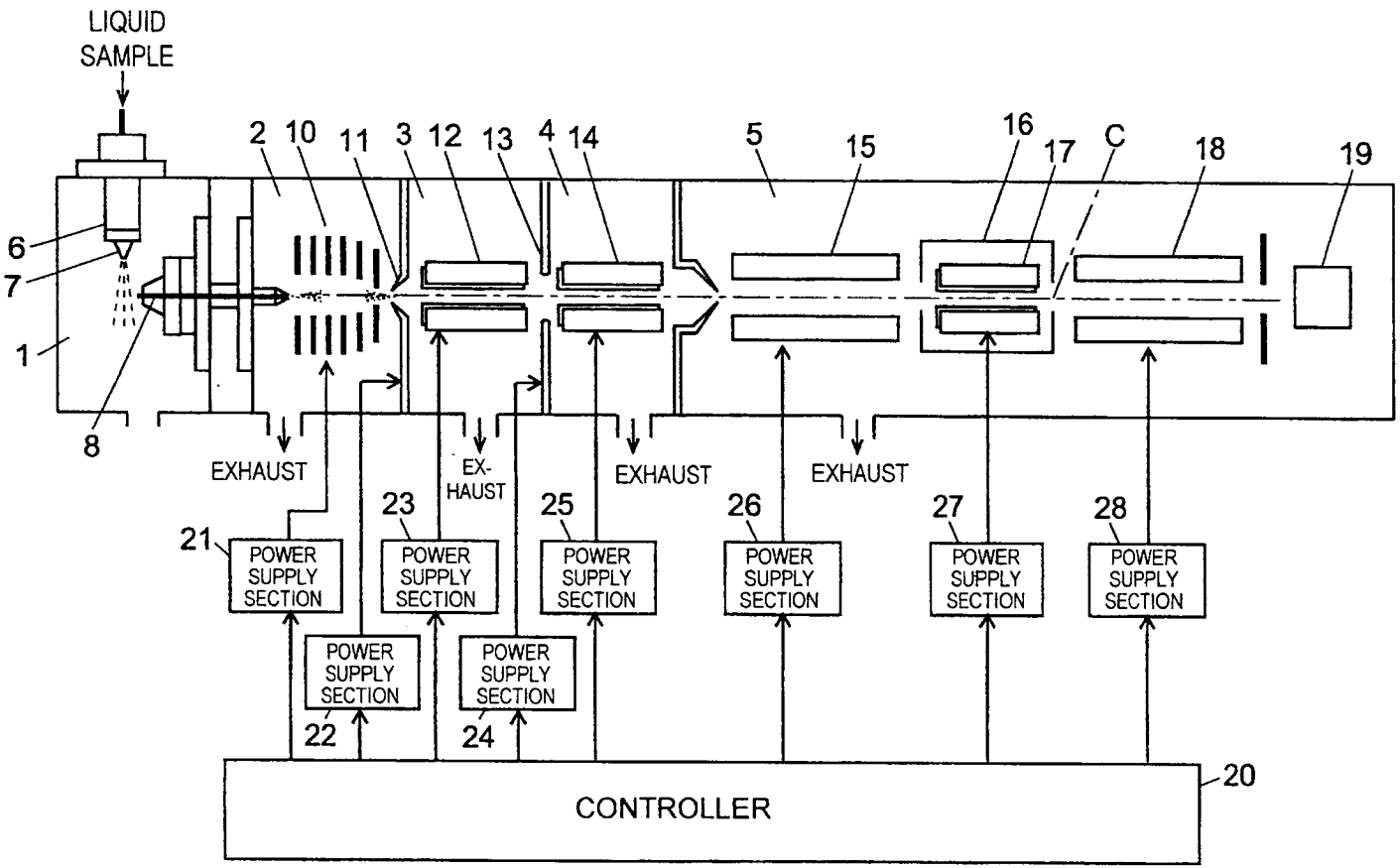
FIG. 1 is an overall configuration diagram of a mass spectrometer according to one embodiment of the present invention.

FIG. 1 is an overall configuration diagram of a mass spectrometer according to a first embodiment. The mass spectrometer is a tandem quadrupole mass spectrometer capable of executing an MS/MS analysis on components in a liquid sample supplied from a liquid chromatograph (LC) or the like.

The mass spectrometer of the present embodiment includes an ionization chamber 1 which is maintained at an approximately atmospheric pressure, an analysis chamber 5 that is maintained under a high vacuum atmosphere by vacuum evacuation using a vacuum pump such as a turbomolecular pump (not shown), and a first intermediate vacuum chamber 2, a second intermediate vacuum chamber 3, and a third intermediate vacuum chamber 4 that are respectively maintained under intermediate gas pressures between a gas pressure in the ionization chamber 1 and a gas pressure in the analysis chamber 5 by vacuum evacuation using a vacuum pump. That is, in the mass spectrometer, the configuration of a multiple-stage differential evacuation system is employed in which the gas pressure becomes lower (the degree of vacuum becomes higher) through the respective chambers from the ionization chamber 1 toward the analysis chamber 5.

In the ionization chamber 1, an ionization probe 6 that is connected to an outlet end of a LC column (not shown) is disposed. In the analysis chamber 5, a front-stage quadrupole mass filter 15, a collision cell 16 in which a fourth ion guide 17 is arranged, a rear-stage quadrupole mass filter 18, and an ion detector 19 are disposed. Also, in the first to third intermediate vacuum chambers 2, 3, and 4, first to third ion guides 10, 12, and 14 are disposed so as to transport ions into a rear stage. The ionization chamber 1 and the first intermediate vacuum chamber 2 communicate with each other via a small-diameter desolventizing tube 8. Also, the first intermediate vacuum chamber 2 and the second intermediate vacuum chamber 3 communicate with each other through a micro-diameter opening formed in a top portion of a skimmer 11, and the second intermediate vacuum chamber 3 and the third intermediate vacuum chamber 4 communicate with each other through a circular opening of an ion lens 13 provided in a partition wall.

The front-stage quadrupole mass filter 15, collision cell 16, and rear-stage quadrupole mass filter 18 constitute a Triple Quadrupole (TF) type mass spectrometer. However, it is understood that other types of mass spectrometers, such as a Time of Flight (TOF) type or Fourier Transform (FT) type mass spectrometer may be provided in the analysis chamber 5.

A high voltage of about several kV is applied to a tip of a nozzle 7 of the ionization probe 6 from a direct current high-voltage power supply (not shown). When a liquid sample introduced into the ionization probe 6 reaches the tip of the nozzle 7, the liquid sample is given a biased electric charge, and sprayed into the ionization chamber 1. Tiny droplets in a mist flow are micronized upon contacting an atmospheric gas, and further micronized with a mobile phase or a solvent volatilized. During the process, sample components included in the droplets break out of the droplets with electric charges, and become gaseous ions. The generated ions are sucked into the desolventizing tube 8 due to a differential pressure between the ionization chamber 1 and the first intermediate vacuum chamber 2, and sent into the first intermediate vacuum chamber 2.

An ion transport optical system from the first ion guide 10 to the third ion guide 14 has a function to transport the ions to the front-stage quadrupole mass filter 15 in the analysis chamber 5 with lowest loss of ions as possible. Power supply sections 21 to 25 respectively apply a voltage in which a direct current voltage and a radio-frequency voltage are superimposed on each other, or a direct current voltage alone to the respective ion guides 10, 12, and 14, the skimmer 11, and the ion lens 13 under the control of a controller 20. The controller 20 may contain a CPU, etc.

The ions are sent into the front-stage quadrupole mass filter 15 by the above ion transport optical system. A voltage in which a direct current voltage and a radio-frequency voltage are superimposed on each other corresponding to a mass-to-charge ratio of an ion as an analysis target is applied to a rod electrode constituting the front-stage quadrupole mass filter 15 from a power supply section 26, and only ions having the mass-to-charge ratio corresponding to the voltage pass through a space in a long-axis direction of the filter 15 to be introduced into the collision cell 16. A predetermined CID gas, such as Ar, is supplied into the collision cell 16 from a gas supply source (not shown), and the ions (precursor ions) collide with the CID gas and are thereby dissociated. Product ions generated by the dissociation are sent to the rear-stage quadrupole mass filter 18 while being converged by the fourth ion guide 17.

A voltage in which a direct current voltage and a radio-frequency voltage are superimposed on each other corresponding to a mass-to-charge ratio of a product ion as an analysis target is applied to a rod electrode constituting the rear-stage quadrupole mass filter 18 from a power supply section 28, and only ions having the mass-to-charge ratio corresponding to the voltage pass through a space in a long-axis direction of the filter 18, and reach the ion detector 19. The ion detector 19 outputs a detection signal corresponding to the amount of the reaching ions, and a data processing section (not shown) creates, for example, an MS/MS spectrum based on the detection signal.

In the above configuration, all of the second ion guide 12, the third ion guide 14, and the fourth ion guide 17 in the collision cell 16 have a function to transport ions into a rear stage while converging the ions. For example, in a conventional mass spectrometer described in Non Patent Literature 1, octupole-type ion guides are used as the second ion guide 12 and the third ion guide 14, and a quadrupole-type ion guide is used as the fourth ion guide 17, while in the mass spectrometer of the present embodiment, ion guides having the same electrode configuration are used as the three ion guides 12, 14, and 17. There are also cases where one or all of the second ion guide 12, the third ion guide 14, and the fourth ion guide 17 are also given the action of removing ions and other particles which are not necessary for analysis. For example, if large amounts of sample solvent derived ions, which hinder analysis, are introduced into the quadrupole mass filter 15, they may cause contamination of the filter 15 or the like, and the function of removing (dispersing) such ions may be given to the ion guide.

In the following, the above ion guide used in the present embodiment is described in detail. The ion guide electrode unit 200, as shown in FIG. 2 may be used in the second ion guide 12, third ion guide 14, and fourth ion guide 17.

Figure 2:
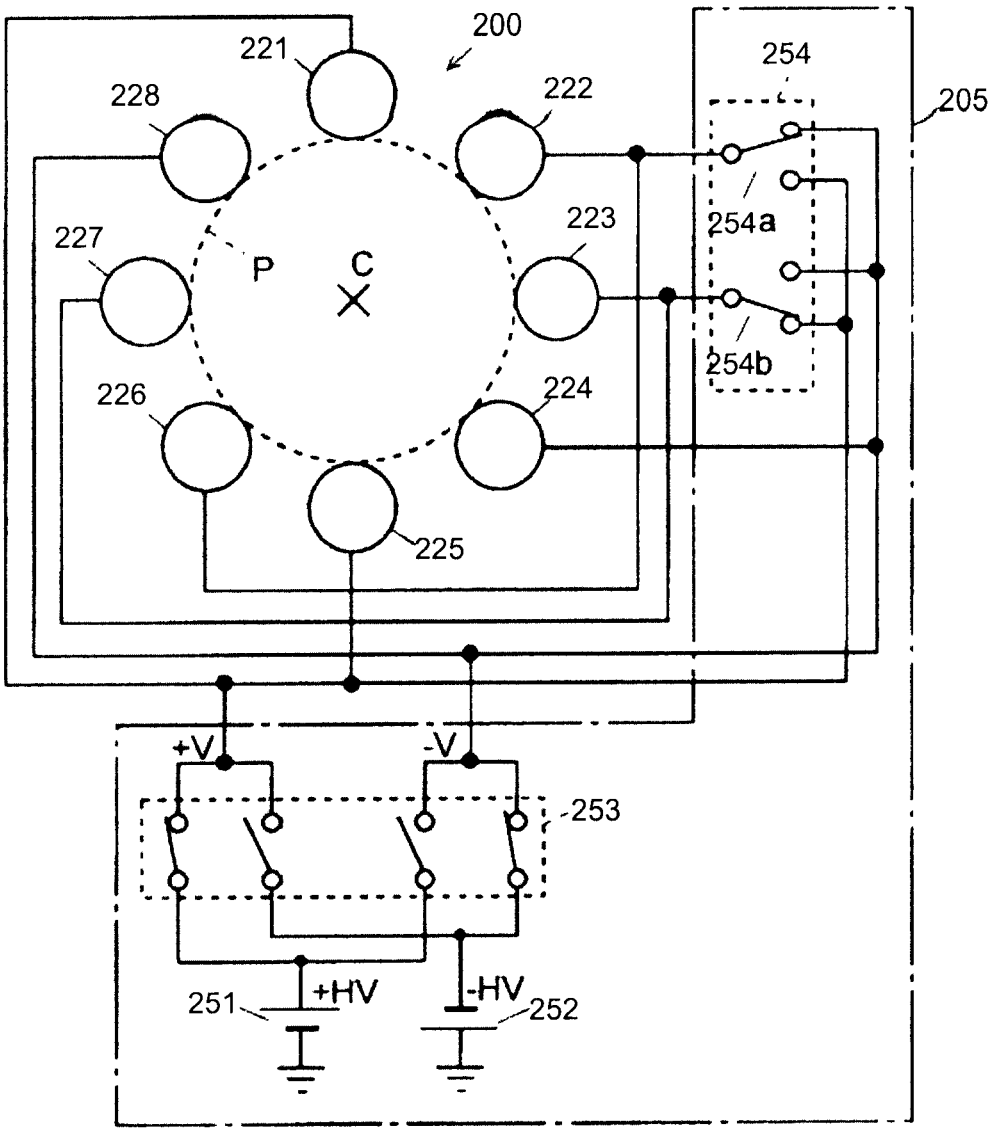
FIG. 2 is a diagram of the main parts in the case where an ion guide containing an electrode unit and power supply unit in the mass spectrometry device according to the present example of embodiment is made to function as an octupole ion guide.
Figure 3:
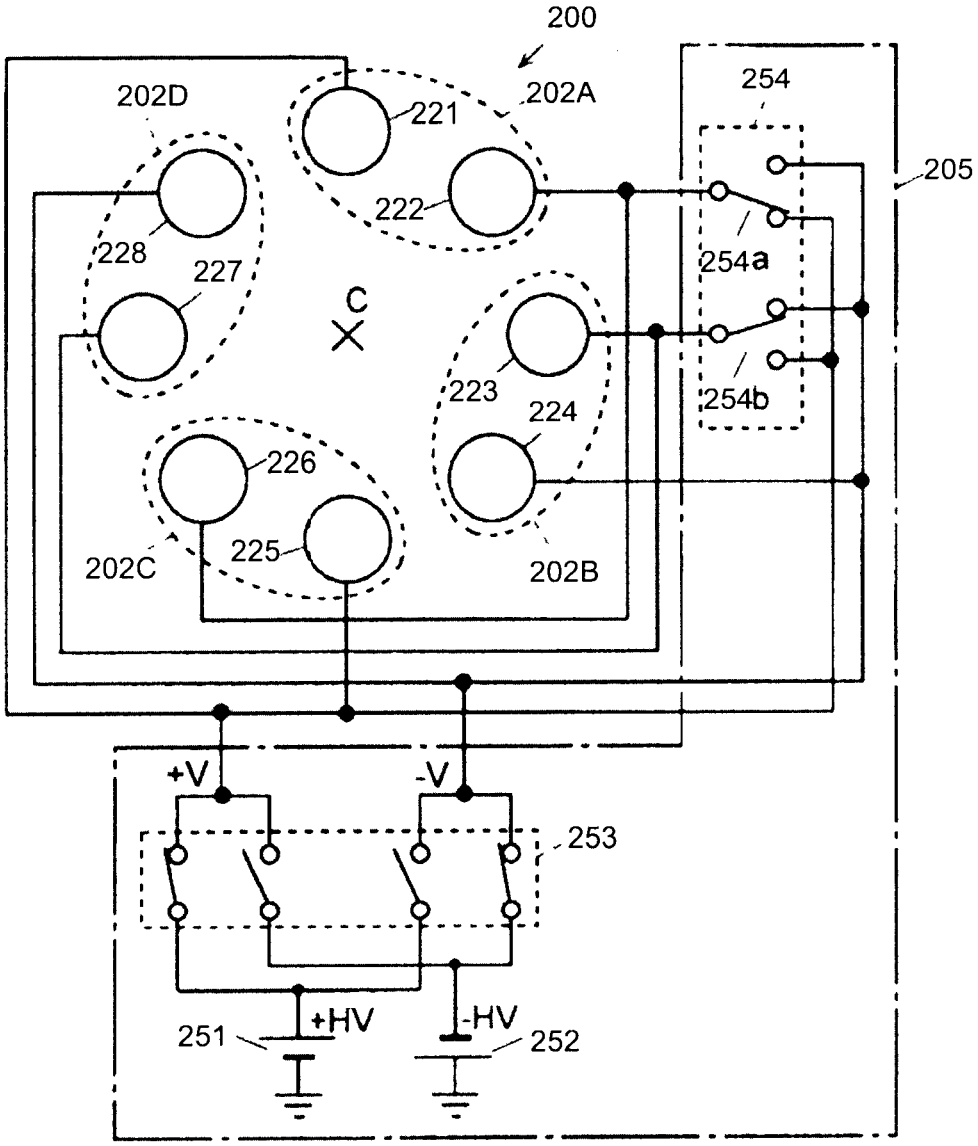
FIG. 3 is a diagram of the main parts in the case where an ion guide containing an electrode unit and power supply unit in the mass spectrometry device according to the present example of embodiment is made to function as a quadrupole ion guide.
Figure 10:
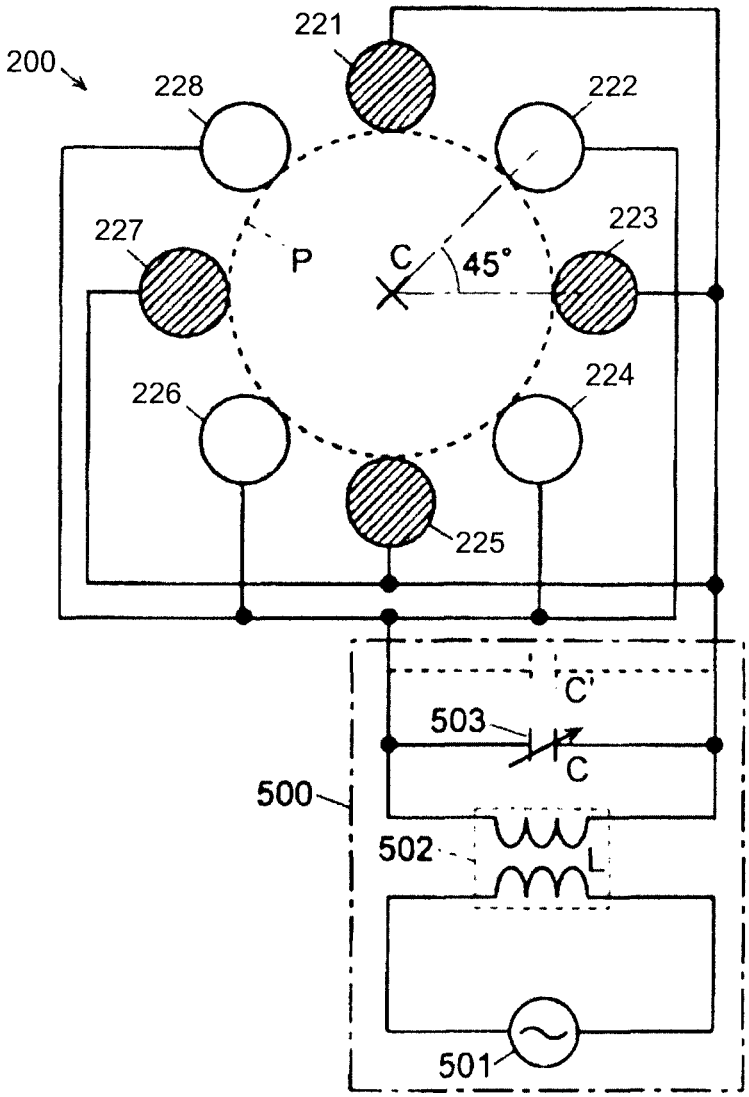
FIG. 10 is a simplified diagram showing the electrode configuration and driving circuit of a conventional octupole ion guide.

In the present example of embodiment, the ion guide electrode unit 200, as shown in FIG. 2, consists of eight substantially round cylindrical rod electrodes 221 through 228 arranged in parallel to each other about a straight linear ion optical axis C and spaced apart at 45° rotational angle intervals. The rod electrodes 221 through 228 are inscribed into a virtual round cylindrical body P having the ion optical axis C as its central axis, and the arrangement of the rod electrodes 221 through 228 is rotationally symmetrical about the ion optical axis C. This arrangement is the same as the electrode arrangement of the conventional octupole ion guide shown in FIG. 10. It will be noted that the ion guide electrode unit 200 shown in FIG. 2 and FIG. 3 is a cross-sectional view cutting through the electrodes 221 through 228 in a plane orthogonal to ion optical axis C, similar to FIG. 10.

Figure 4:
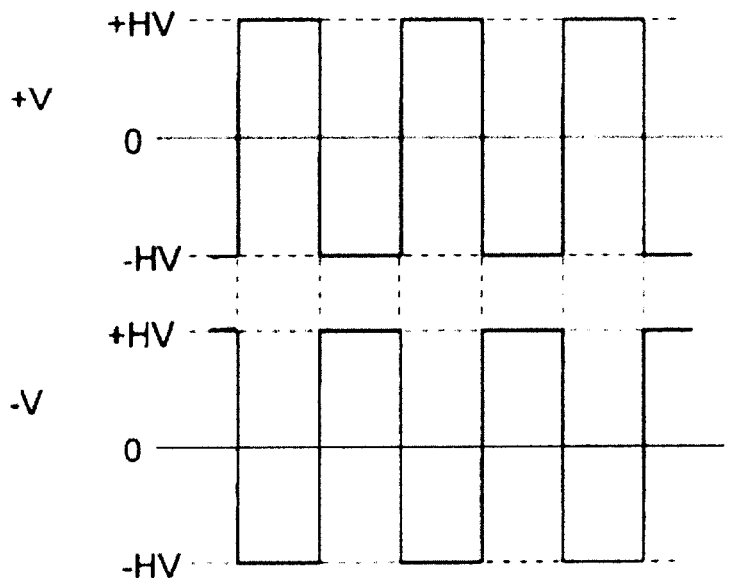
FIG. 4 is a waveform diagram of the square wave voltage applied to rod electrodes in the mass spectrometry device according to the present example of embodiment.

Ion guide power supply unit 205 contains a circuit which does not generate sinusoidal high voltage but rather generates square wave high voltage. Namely, ion guide power supply unit 205 comprises, as the voltage generator of the present invention, a direct current positive power supply 251 with a voltage level of +HV, and direct current negative power supply 252 with a voltage level of −HV, and a voltage generation switch 253 which rapidly switches between voltage from the direct current positive power supply 251 and the voltage from the direct current negative power supply 252 to generate a first square wave voltage (+V) with an amplitude of 2 HV and a frequency f, and a second square wave voltage (−V) with the opposite phase thereto (phase displaced by 180°), as shown in FIG. 4. The individual switches making up the voltage generation switch 253 need to have high operating speed and high voltage resistance, so normally, semiconductor switching elements such as power MOSFETS are used for this purpose.

Ion guide power supply unit 205 further comprises, as the connection switch of the present invention, an electrode changeover switch 254 which is inserted into the wiring path connecting the square wave voltage generating unit consisting of direct current positive power supply 251, direct current negative power supply 252 and voltage generation switch 253, to the rod electrodes 221 through 228. This electrode changeover switch 254 contains two 2-input/1-output switches 254*a*, 254*b*, one of which is used for application of first square wave voltage (+V) and the other for application of second square wave voltage (−V). This electrode changeover switch 254 can be fashioned using a semiconductor switching element, similarly to voltage generation switch 253, but in cases where high speed switching characteristics are not especially required, a relay having metal contact points may be used as well. The two 2-input/1-output switches 254*a*, 254*b* contained in the electrode changeover switch 254 perform interlocked switching such that when one selects the upper input, the other selects the lower input, as shown in FIG. 2 and FIG. 3.

Next, the operation of the ion guide with the above configuration will be described. When one wishes to make this ion guide function as an octupole ion guide, the controller 20 places the electrode changeover switch 254 into the state shown in FIG. 2. In this state, of the eight rod electrodes 221 through 228, four rod electrodes 222, 224, 226 and 228 are connected to each other through 2-input/1-output switch 254*a*, and four rod electrodes 221, 223, 225 and 227 are connected to each other via 2-input/1-output switch 254*b*. Namely, every other rod electrode around the ion optical axis C is connected to each other, just as in the electrode connection state shown in FIG. 10. The first square wave voltage (+V) is applied to one set of four rod electrodes 221, 223, 225, 227, and the second square wave voltage (−V), which has the same amplitude but the opposite phase, is applied to the other four rod electrodes 222, 224, 226, 228.

Figure 11:
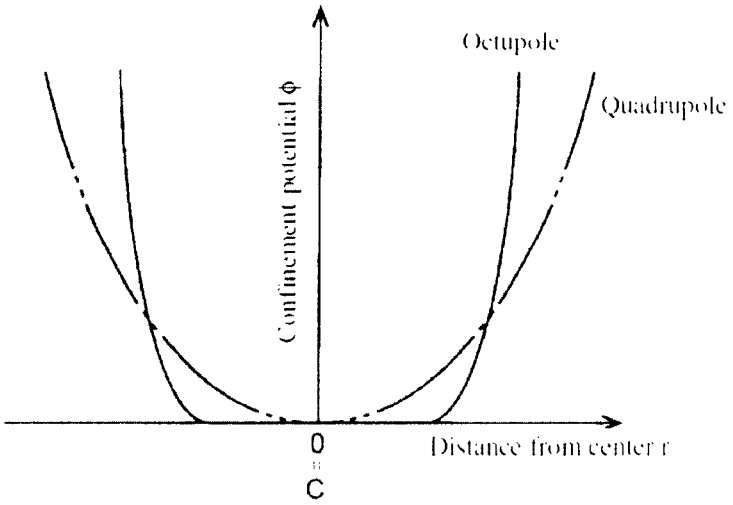
FIG. 11 is a schematic of the relationship between radial distance r from the ion optical axis (center) and the confinement potential $\phi$ in a quadrupole ion guide and octupole ion guide.
Figure 12A:
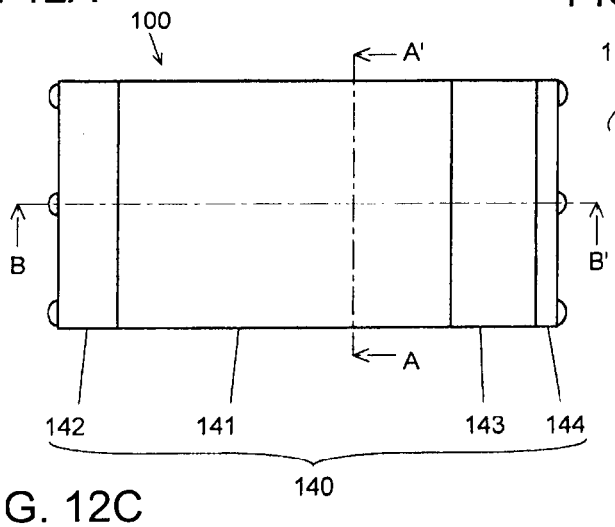
FIG. 12A is a side view of a conventional ion guide unit.
Figure 12B:
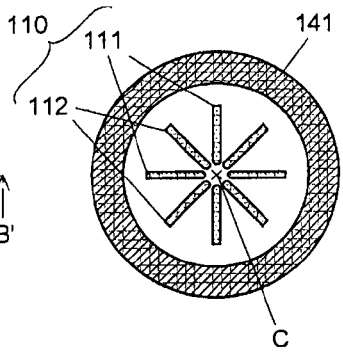
FIG. 12B is a sectional view on a line A-A' and FIG. 12C is a sectional view on a line B-B' in FIG. 12A
Figure 12C:
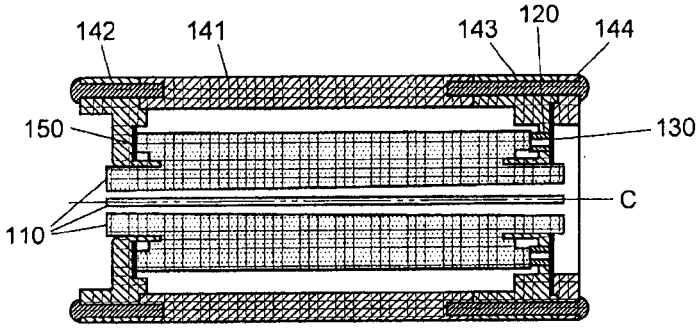
Figure 13:
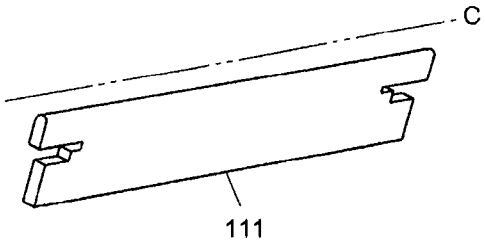
FIG. 13 is a perspective view of an electrode in FIG. 12A, FIG. 12B, and FIG. 12C.
Figure 14A:
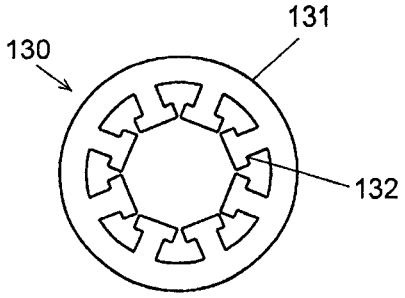
FIG. 14A is a plan view of a disk spring and FIG. 14B is a plan view of a thin plate in FIG. 12A, FIG. 12B, and FIG. 12C.
Figure 14B:
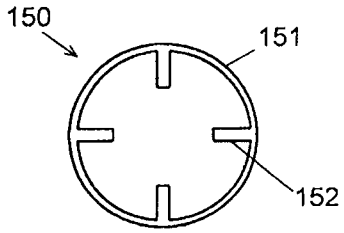
Figure 15:
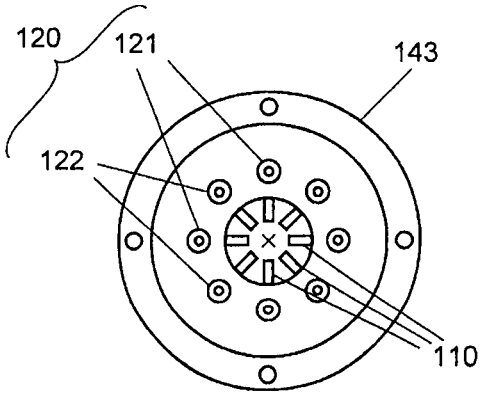
FIG. 15 is a plan view of the ion guide unit before the disk spring and a disk spring fixing section are attached thereto.
Figure 16:
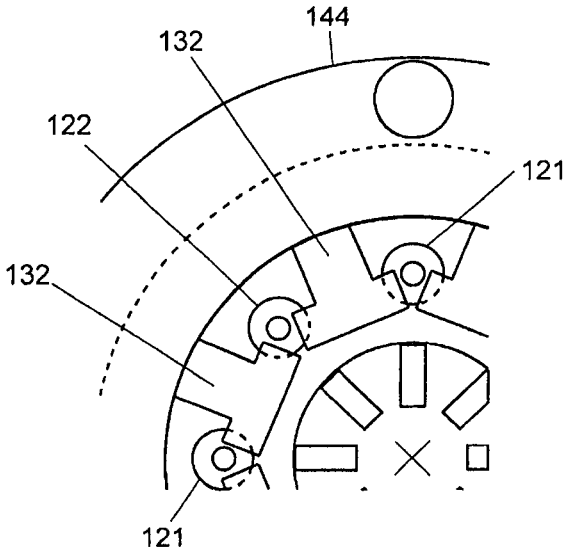
FIG. 16 is an enlarged plan view of the ion guide unit after the disk spring and the disk spring fixing section are attached thereto.

As a result, an octupole electric field is formed in the space surrounded by the eight rod electrodes 221 through 228, and ions introduced into this space are transported while being focused by the octupole electric field. The octupole electric field here has a shape symmetrical about the ion optical axis C, so the confinement potential in the diametric direction is as shown in FIG. 11. Namely, a large amount of ions can be stably sent to the subsequent stage due to high confinement capacity.

Furthermore, when one wishes to make this ion guide function as a quadrupole ion guide, the controller 20 switches the electrode changeover switch 254 to the state shown in FIG. 3. In this state, of the eight rod electrodes 221 through 228, four rod electrodes 221, 222, 225 and 226 are connected to each other via 2-input/1-output switch 254*a*, and four rod electrodes 223, 224, 227 and 228 are connected to each other via 2-input/1-output switch 254*b*. Namely, as shown by the dotted line in FIG. 3, four sets 202A, 202B, 202C and 202D are formed, taking two circumferentially adjacent rod electrodes as one set, and the two sets 202A and 202C, and 202B and 202D, which face each other across the ion optical axis C, are connected to each other. A first square wave voltage (+V) is applied to the four rod electrodes 221, 222, 225 and 226 belonging to the first two sets 202A and 202C, and the second square wave voltage (−V) of the same amplitude but opposite phase is applied to the circumferentially adjacent four rod electrodes 223, 224, 227 and 228 belonging to the other two sets 202B and 202D.

The same square wave voltage is applied to two circumferentially adjacent rod electrodes belonging to the same set, so no potential difference is generated and no effective electric field is present between these two rod electrodes. Therefore, the two rod electrodes belonging to the same set can be virtually considered to be a single rod electrode, in which case there would be four virtual rod electrodes, and the configuration can be viewed as a quadrupole configuration in which a square wave voltage of reverse phase is applied to circumferentially adjacent virtual rod electrodes. As a result, a quadrupole electric field is effectively formed in the space surrounded by the eight rod electrodes 221 through 228, and the ions introduced into this space are transported while being focused by the quadrupole electric field. The quadrupole electric field here has a symmetrical shape centered on ion optical axis C, so the confinement potential in the diametric direction is as shown in FIG. 11. Namely, while the confinement capacity is inferior compared to the octupole configuration shown in FIG. 2, the majority of the trapped ions gather near the ion optical axis C, allowing ions to be fed more efficiently to the ion optical elements of the subsequent stage, such as the front-stage quadrupole mass filter 15.

When the connection state is switched by the electrode changeover switch 254, the electrostatic capacitance between circumferentially adjacent rod electrodes changes, but since the amplitude and frequency of the first and second square wave voltages (+V, −V) is not affected by such change in electrostatic capacitance, the ion guide can be made to function as a quadrupole or octupole starting immediately after switching. It is thus possible to switch the effective number of poles of the ion guide rapidly even during analysis, for example, allowing one to perform switching as appropriate to the mass-charge ratio range, etc. of the ions to be analyzed.

The ion guide electrode unit 200 can be used in all of the second ion guide 12, third ion guide 14, and fourth ion guide 17. In this case, the ion guides 12, 14, and 17 have the same electrode shape and arrangement, yet voltages can be applied to the respective rod electrodes 221 to 228 in different manners. For example, the second and third ion guides 12 and 14 can be operated as an octupole while the fourth ion guide 17 is operated as a quadrupole. However, by actuation of the electrode changeover switch 254, the electric field formed by the rod electrodes 221 to 228 can be rapidly changed to a quadrupole electric field to an octupole electric field, or vice versa. Also, an ion guide unit such as ion guide unit 100 shown in FIG. 12 to FIG. 16 may be used as the ion guide.

In the above-described example embodiment, an ion guide electrode unit 200 consisting of eight rod electrodes was made to operate as either an octupole or a quadrupole, but expansion to other multipole forms is also possible, as will be described later.

In the example embodiment above, the generated multipole electric field is symmetrical about the ion optical axis C, and ions basically are most readily present near the ion optical axis C. This is due to the fact that the arrangement of the rod electrodes is rotationally symmetrical and that the number of rod electrodes of each set is made equal when multiple circumferentially adjacent rod electrodes are made into sets. By contrast, enabling the switching of the connection state so as to allow one to intentionally change the number of rod electrodes belonging to each set would make it possible to form multipole electric fields which are asymmetrical about the ion optical axis C and to thereby control the behavior of the ions.

Figure 5:
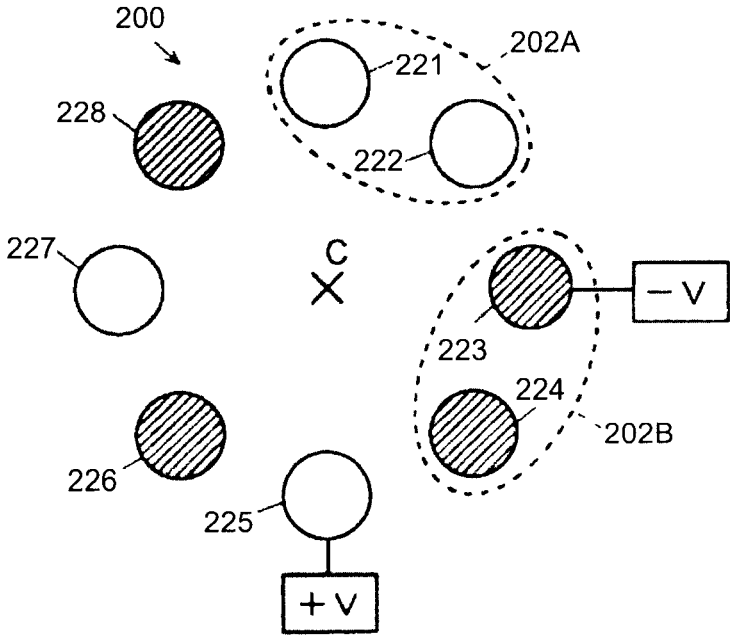
FIG. 5 is a diagram of the main parts of an ion guide in a mass spectrometry device according to another example of embodiment of the present invention.

FIG. 5 is a simplified diagram of an ion guide in a mass spectrometry device according to another example embodiment (second example embodiment) of the present invention. The ion guide electrode unit 200 in this second example embodiment comprises eight rod electrodes 221 through 228 similar to the ion guide electrodes in the first example embodiment above; however, two circumferentially adjacent rod electrodes 221, 222 and rod electrodes 223, 224 are each treated as one group, and the other four rod electrodes 225 through 228 are each individually treated as one group when switching with an unillustrated electrode changeover switch. For the six sets of virtual rod electrodes 202A, 202B, 225, 226, 227, 228 formed in this manner and containing one or two rod electrodes each, a first square wave voltage (+V) is applied to one and a second square wave voltage (−V) is applied to the other of two circumferentially adjacent sets of virtual rod electrodes. As a result, a hexapole electric field is formed in the space surrounded by the eight rod electrodes 221 through 228, and since the arrangement of the virtual rod electrodes is asymmetrical about the ion optical axis C, the shape of the electric field formed is also asymmetrical.

In this case, the center of the bottom of the confinement potential is not the ion optical axis C shown in FIG. 5. Namely, the ion optical axis in the space surrounded by the rod electrodes 221 through 228 of this ion guide is not at the location of symbol C in FIG. 5 but is offset from that location, and this ion guide constitutes an off-axis ion optical system in which the ion input optical axis and the ion output optical axis are not on the same line. Therefore, enabling switching between a connection state of rod electrodes as shown in FIG. 2 or FIG. 3 and a connection state of rod electrodes as shown in FIG. 5 makes possible the switching between an off-axis ion optical system and a regular ion optical system which is not off-axis (where the ion input optical axis and ion output optical axis are location on the same line).

An off-axis ion optical system makes it possible to separate neutral particles which are unaffected by electrical fields from ions and remove them. Here, as one example, separate mass spectrometers are provided at the location where ions are outputted when the ion guide is operated as an off-axis ion optical system and at the location where ions are outputted when the ion guide is operated as a normal ion optical system. Then, by switching what mass spectrometer is used to perform mass spectrometry according to the purpose of analysis, the analysis conditions, etc., differential use becomes possible, whereby, under conditions with many neutral particles, etc., such particles are removed by axis offset to perform analysis at a high SN ratio, and under conditions where there are few neutral particles and the like, ions are efficiently fed into the mass spectrometer and analysis is performed at high sensitivity without performing axis offset. Furthermore, a configuration may be employed wherein the mass spectrometer is shared, and when the ion guide is operated as an off-axis ion optical system, the outputted ions are guided into the shared mass spectrometer through an ion transport tube, etc.

Figure 6A:
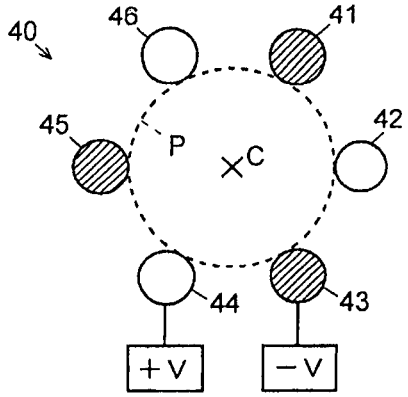
FIG. 6A and FIG. 6B are views illustrating an example of an application state of a radio-frequency voltage in an ion guide according to a further embodiment.
Figure 6B:
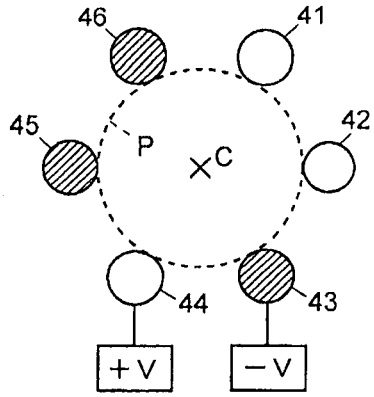
Figure 7A:
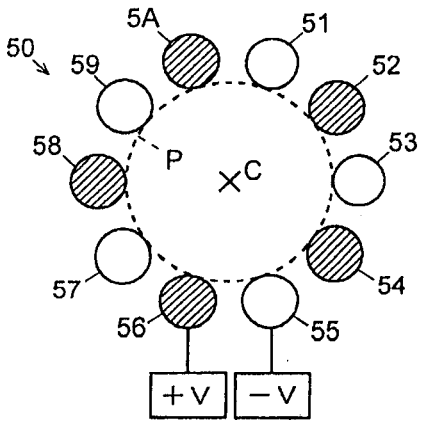
FIG. 7A and FIG. 7B are views illustrating an example of an application state of a radio-frequency voltage in an ion guide according to a further embodiment.
Figure 7B:
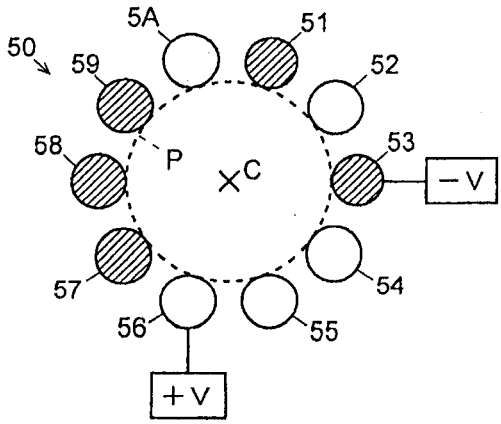
Figure 8A:
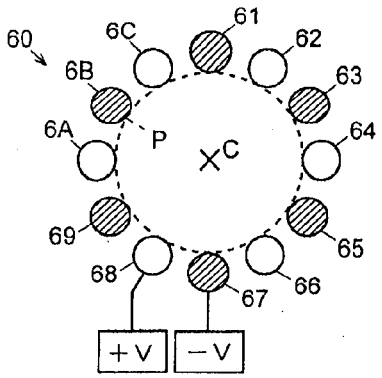
FIG. 8A and FIG. 8B are views illustrating an example of an application state of a radio-frequency voltage in an ion guide according to a further embodiment.
Figure 8B:
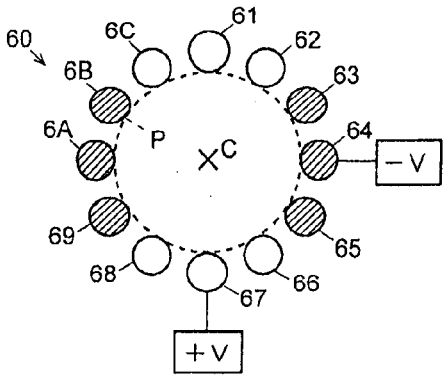
Figure 9:
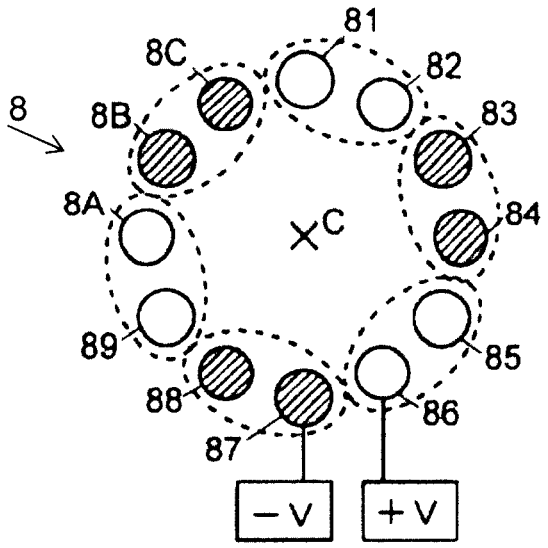
FIG. 9 is a diagram of the main parts of an ion guide in a mass spectrometry device according to another example embodiment of the present invention.

Also, while the above embodiments are examples in which the number of the electrodes *is* 8, the number of the electrodes may be N (N is an integer equal to or larger than 6). FIG. 6A to FIG. 8C are views respectively illustrating application states of radio-frequency voltages to respective electrodes constituting ion guides 40, 50, and 60 when N is 6, 10, and 12. All of FIG. 6A, FIG. 7A, and FIG. 8A show voltage application states when the respective ion guides 40, 50, and 60 are operated as hexapole-type, decapole-type, and dodecapole-type ion guides according to the respective numbers of the electrodes. On the other hand, FIG. 6B, and FIG. 7B are views illustrating one example of application states of radio-frequency voltages when a deflection electric field is formed. Also, FIG. 8B shows a voltage application state when the ion guide having 12 electrodes is operated as the pseudo quadrupole-type ion guide. Furthermore, if two circumferentially adjacent rod electrodes are taken as a set, a first square wave voltage (+V) is applied to one circumferentially adjacent set and a second square wave voltage (−V) is applied to the other, as shown in FIG. 9, this will function effectively as a hexapole ion guide. In this way, the configuration of the electrode changeover switch for changing between connection states of the rod electrodes although not illustrated, is obvious from the description given in the first example embodiment. As described above, the present invention is not limited to the case in which N is 8, and can be applied to an ion guide having any number N electrodes, wherein N is greater than or equal to 6.

Furthermore, all the above example embodiments are merely examples of the present invention, and it is obvious that suitable modifications, corrections and additions within the gist of the present invention are included within the scope of patent claims of the present application. For example, it is obvious that the ion guide according to the present invention can be used not only in cases where ions are fed to a mass spectrometer such as a quadrupole mass filter, but also in cases where ions are fed to a collision cell in a tandem quadrupole mass spectrometry device and in cases where ions are fed to a three-dimensional quadrupole ion trap in an ion trap mass spectrometry device (or ion trap time of flight mass spectrometry device) and the like.

DESCRIPTION OF REFERENCE CHARACTERS

1 . . . Ionization Chamber
2 . . . First Intermediate Vacuum Chamber
3 . . . Second Intermediate Vacuum Chamber
4 . . . Third Intermediate Vacuum Chamber
5 . . . Analysis Chamber
6 . . . Ionization Probe
7 . . . Nozzle
8 . . . Desolventizing Tube
10 . . . First Ion Guide
11 . . . Skimmer
12 . . . Second Ion Guide
13 . . . Ion Lens
14 . . . Third Ion Guide
15 . . . Front-Stage Quadrupole Mass Filter
16 . . . Collision Cell
17 . . . Fourth Ion Guide
18 . . . Rear-Stage Quadrupole Mass Filter
19 . . . Ion Detector
20 . . . Controller
21 to 28 . . . Power Supply Section
41 to 46, 51 to 5A, 61 to 6C . . . Rod Electrode
40, 50, 60 . . . Ion Guide
100 . . . Ion Guide Unit
110 . . . Ion Guide
111 . . . First Electrode
112 . . . Second Electrode
121 . . . Insulating Spacer
122 . . . Conducting Spacer
130 . . . Disk Spring
131 . . . Frame Portion
132 . . . Spring Portion
140 . . . Case
141 . . . Tubular Section
142 . . . First Support Section
143 . . . Second Support Section
144 . . . Disk Spring Fixing Section
150 . . . Thin Plate
151 . . . Frame Portion
152 . . . Metal Contact
C . . . Ion Optical Axis
200, 8 . . . ion guide electrode unit
221, 222, 223, 224, 225, 226, 227, 228, 81, 82, 83, 84, 85, 86, 87, 88, 89, 8A, 8B, 8C . . . rod electrode
202A, 202B, 202C, 202D . . . virtual rod electrode
251 . . . direct current positive power supply
252 . . . direct current negative power supply
253 . . . voltage generation switch
254 . . . electrode changeover switch
254*a*, 254*b* . . . 2-input/1-output switch

What is claimed is:

1. A method of operating an ion guide, the ion guide comprising: (a) an electrode unit including a number N, wherein N is an integer not less than 6, of rod-shaped or plate-shaped electrodes arranged so as to surround an ion optical axis, the electrode unit transports ions to a subsequent stage while focusing ions by action of a high frequency electric field formed in a space surrounded by said N electrodes, (b) a voltage generator configured to generate a first square wave voltage of predetermined frequency and predetermined amplitude and a second square wave voltage of opposite phase to said first square wave voltage as voltages for forming the high frequency electric field in the space surrounded by said N electrodes, and (c) a connection switch configured to switch the electrode unit between a first state and a second state;

the method comprising:

grouping the electrodes in a number 2M of sets in the first state, wherein M is an integer not less than 2;

grouping the electrodes in a number 2L of sets in the second state, wherein L is an integer not less than 3 and greater than M; and causing an electrical connection to be established between electrodes of said voltage generator and said electrode unit such that the first square wave voltage is applied to one of the sets and the second square wave voltage is applied to another of the sets which is circumferentially adjacent to the one of the sets, wherein in both said first and second states, each of the sets includes either only one of the electrodes or a plurality of circumferentially adjacent electrodes electrically connected to one another.

2. The method of operating the ion guide according to claim 1, wherein in said second state, all of the sets consist of one electrode each, and in said first state, all of the sets consist of a number P, wherein P is an integer not less than 2, of circumferentially adjacent electrodes.

3. The method of operating the ion guide according to claim 1, wherein in said second state, all of the sets consist of a number P of circumferentially adjacent electrodes, and in said first state, all of the sets consist of a number Q, wherein Q is an integer greater than P, of circumferentially adjacent electrodes.

4. The method of operating the ion guide according to claim 2, wherein 4M=2L=N.

5. The method of operating the ion guide according to claim 4, wherein M=2, L=4, and N=8.

6. The method of operating the ion guide according to claim 3, wherein 4M=2L=N.

7. The method of operating the ion guide according to claim 6, wherein M=2, L=4, and N=8.

8. A mass spectrometry device, comprising an ion guide, the ion guide comprising:

a) an electrode unit including a number N, wherein N is an integer not less than 6, of rod-shaped or plate-shaped electrodes arranged so as to surround an ion optical axis, the electrode unit transports ions to a subsequent stage while focusing ions by action of a high frequency electric field formed in a space surrounded by said N electrodes, b) a voltage generator configured to generate a first square wave voltage of predetermined frequency and predetermined amplitude and a second square wave voltage of opposite phase to said first square wave voltage as voltages for forming the high frequency electric field in the space surrounded by said N electrodes, and c) a connection switch configured to switch the electrode unit between a first state and a second state;

a controller which controls the switching of connections by said connection switch according to analysis conditions including the mass-charge ratio range of the ions to be analyzed; and a mass filter disposed downstream of the ion guide;

wherein:

in the first state, the electrodes are grouped in a number 2M of sets, wherein M is an integer not less than 2, in the second state, the electrodes are grouped in a number 2L of sets, wherein L is an integer not less than 3 and greater than M, and in both said first and second states, each of the sets includes either only one of the electrodes or a plurality of circumferentially adjacent electrodes electrically connected to one another; and the connection switch causes an electrical connection to be established between electrodes of said voltage generator and said electrode unit such that the first square wave voltage is applied to one of the sets and the second square wave voltage is applied to another of the sets which is circumferentially adjacent to the one of the sets.

9. The mass spectrometry device of claim 8, wherein the mass filter includes one of a Time of Flight (TOF) type or Fourier Transform (FT) type mass analyzer.

* * * * *